US006055673A

United States Patent [19]

McCormick

[11] Patent Number: 6,055,673

[45] Date of Patent: May 2, 2000

[54] GARMENTS WITH ADJUSTABLE SIZING FEATURE

[75] Inventor: James Patrick McCormick, Englewood Cliffs, N.J.

[73] Assignee: Generation X International Corp., New York, N.Y.

[21] Appl. No.: 09/159,727

[22] Filed: Sep. 24, 1998

[51] Int. Cl.[7] ..... A41D 1/06

[52] U.S. Cl. ..... 2/227; 2/232

[58] Field of Search ..... 2/232, 227, 243.1, 2/269; D2/742, 743

[56] References Cited

U.S. PATENT DOCUMENTS

| | | | |
|---|---|---|---|
| 901,041 | 11/1908 | Ring | 2/227 |
| 1,037,945 | 9/1912 | Kranzberg | 2/227 |
| 2,127,355 | 8/1938 | Grundstorm | 2/227 |
| 2,227,214 | 12/1940 | Bisberg | 2/243 |
| 2,724,120 | 11/1955 | Biern | 2/211 |
| 4,215,435 | 8/1980 | Miele | 2/227 |
| 4,343,045 | 8/1982 | Ferrari | 2/92 |
| 5,088,128 | 2/1992 | Kape | 2/269 |
| 5,416,928 | 5/1995 | Koenig | 2/244 |
| 5,513,392 | 5/1996 | Douglas et al. | 2/207 |

*Primary Examiner*—John J. Calvert
*Assistant Examiner*—Alissa L. Hoey
*Attorney, Agent, or Firm*—Ostrager Chong Flaherty & Onofrio, P.C.

[57] ABSTRACT

A pants having frayable leg bottoms is provided by provision of at least one circumferential thread stitching proximate each leg bottom. The circumferential thread stitching provides a defined boundary for fraying and cutting the leg bottom to a selected length. The pant legs are cut below the stitching line to define the fabric area for fraying in the pant legs. Fraying in the legs is then provided by separation of yarns at cut bottoms in normal wear and laundering of the pants. In a preferred embodiment, the pant legs include multiple circumferential double needle top stitching rows of thread which are spaced apart from the leg bottoms.

12 Claims, 2 Drawing Sheets

GARMENTS WITH ADJUSTABLE SIZING FEATURE

FIELD OF THE INVENTION

This invention generally relates to sportswear apparel including a sizing feature which permits consumers to tailor garment leg and arm lengths and provide a frayed trim. More particularly, it is concerned with a stitching technique for finishing the bottoms of pants legs to permit the sizing of pants with conventional cutting techniques. Garments sized according to the invention have a uniform length and frayed finish.

DESCRIPTION OF THE PRIOR ART

It has long been fashionable to fray the bottoms of denim jean pants. Denim materials have a twill-weave and fray when the material is not finished with a seam or the seam is cut-off. Fraying is further enhanced by spreading of yarns in normal wear and tear and laundering of the garment.

Generally, it has not been the practice of industry to market denim with unfinished edges because fraying of the garments in use is non-uniform and limits the useful life of the garment.

The present invention resides in the discovery that uniform frayed finish and sizing may be provided in denim pants by stitching the periphery of the legs with thread or yarn proximate the pants leg bottoms. Stitch patterns are selectively positioned at pants leg bottoms to provide controlled fraying of the denim fabric.

SUMMARY OF THE INVENTION

In accordance with the present invention, pants having frayable leg bottoms are provided by provision of at least one circumferential thread stitching proximate each leg bottom. The circumferential thread stitching provides a defined boundary for fraying and cutting the leg bottom to a selected length. The pants legs are cut below the stitching line to define the fabric area for fraying in the pants legs. Fraying is then provided by separation of yarns at the cut bottoms and by normal wear and laundering of the pants.

In a preferred embodiment, the pants legs include multiple circumferential double needle top stitching rows of thread which are spaced apart from each other and the leg bottoms. Use of double row stitchings enhances the strength of the stitch boundary for controlled fraying of cut fabric. The pants are preferably made of denim in a cotton twill weave and provided with a finished inseamed cuff secured by spaced first and second rows of double needle top thread stitchings. It is preferred to provide a first double row of stitchings in the area spaced approximately ¾ inch or more from the leg bottom, and a second row spaced 1½ inch inward from the first row and proximate a top edge of the cuff. Additional double needle top stitching rows may be provided in the pants legs spaced approximately 1½ inches apart.

Other objects, features and advantages of the present invention will be apparent when the detailed description of the preferred embodiments of the invention are considered in conjunction with the drawings which should be construed in an illustrative and not limiting sense as follows:

DETAILED DESCRIPTION OF THE INVENTION

Figure 1:
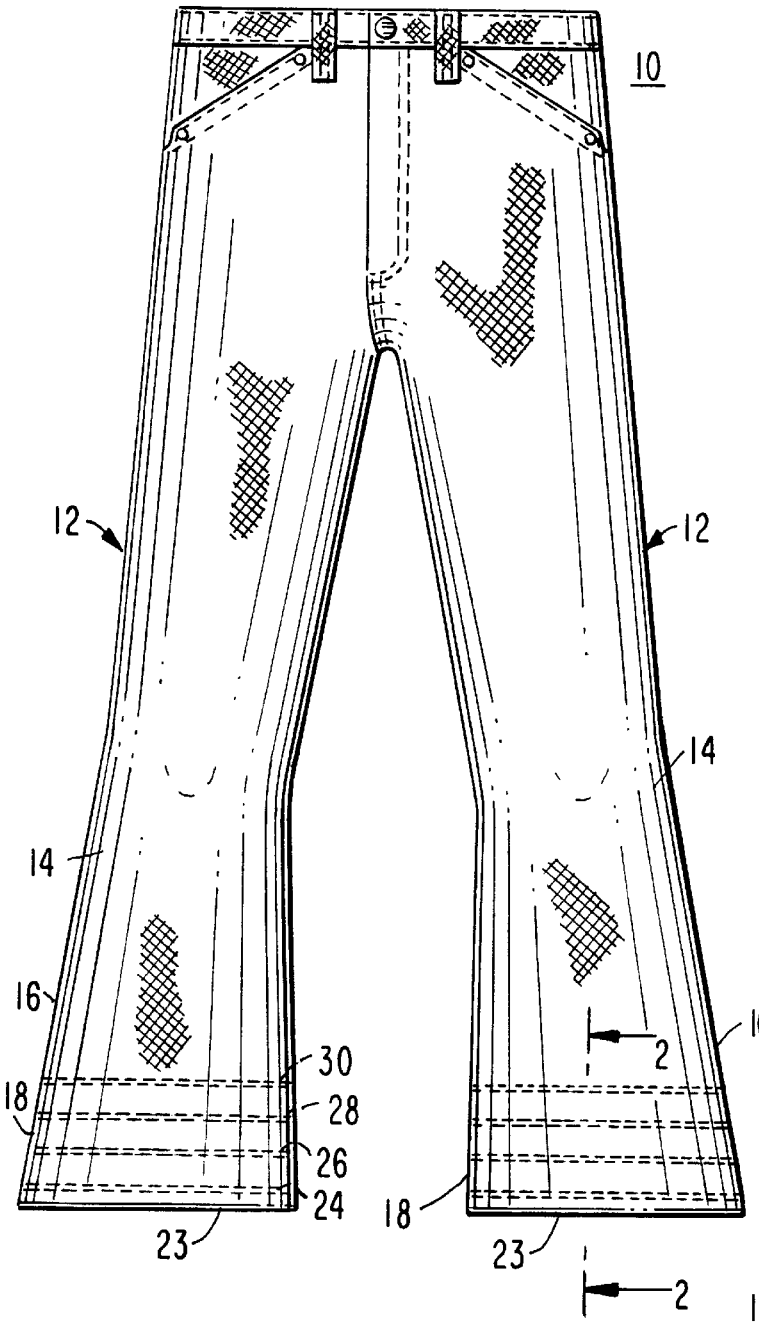
FIG. 1 is a front elevational view of a denim pants including frayable leg bottoms in accordance with the invention.
Figure 2:
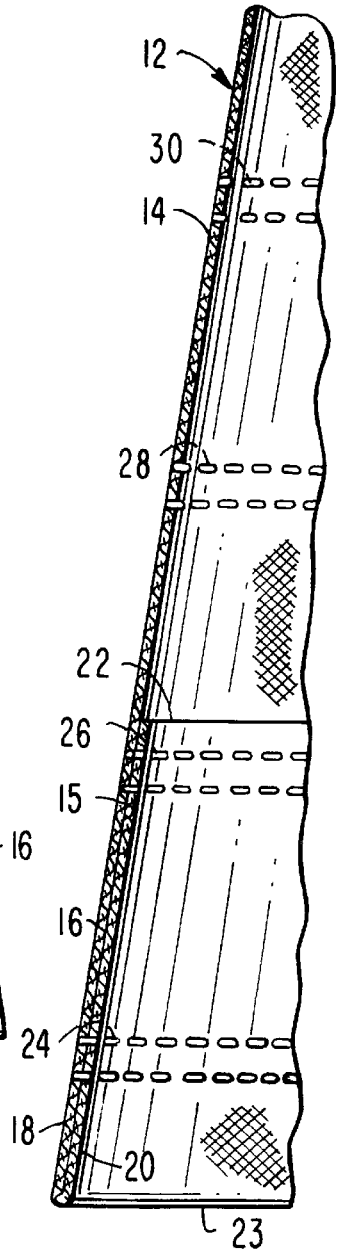
FIG. 2 is a cross-sectional view of the frayable leg bottom taken along the line 2—2 of FIG. 1.

Referring to FIG. 1, a denim pants 10 in accordance with the invention has legs 12 which include denim fabric layer 14 and bell bottom legs 16. Each leg bottom is finished with an infolded cuff 18 having an inner fold layer 20, top edge 22 and bottom edge 23. The cuff 18 is secured to an inner surface 15 of the pants legs 12 by spaced rows of double needle top stitches 24, 26. As shown in FIG. 2, a first row of double stitchings 24 is spaced inward from the bottom edge 23 of each leg 16, and a second row 26 which is proximate the top edge 22 of the cuff. Additional double rows of stitchings 28 to 30 may be provided proximate the leg bottoms.

Preferred spacings for the stitch rows 24 to 30 are as follows: each of the double stitching rows 24 to 30 are defined by stitch rows which are spaced approximately a ¼ inch apart; the first double row of stitches is spaced approximately ¾ inch from bottom edge 23; and the double rows 24 to 30 are each spaced approximately 1½ inch apart.

The rows of double stitchings 24 to 30 provide defined boundaries for cutting the leg bottoms to a selected length and fraying the unfinished edge. Fraying in the legs is provided by separation of yarns at cut bottoms, laundering, and normal wear and tear of the pants.

Figure 3:
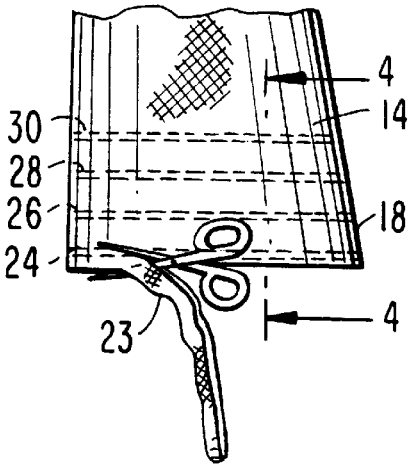
FIG. 3 is a partial sectional view of the frayable leg bottom showing the cutting of a bottom end of the leg at a first selected length in an area between spaced lines of stitchings to provide a frayable bottom finish.
Figure 4:
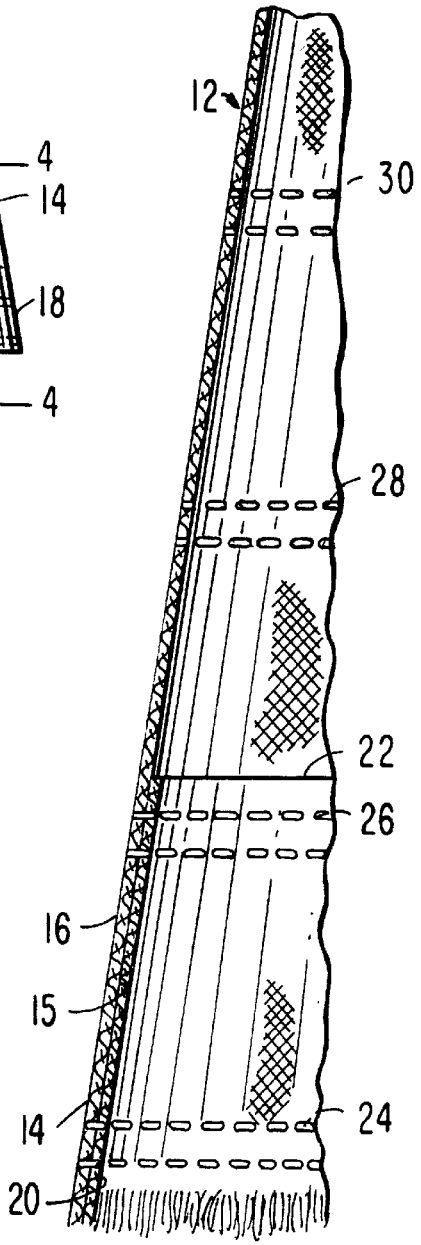
FIG. 4 is a partial sectional view of the frayable leg bottom with frayed finish taken along the line 4—4 of FIG. 3.

FIGS. 3 and 4 show an alteration of pants 10 by a first selected cutting of the pant legs in the cuff 18 in the area between bottom edge 23 and double stitching row 24. The cutting of leg bottoms in the cuff area provides overlapping and unfinished outer fabric and cuff layers 14 and 20. The fraying of these unfinished fabric layers is provided in the area of cut fabric. Fraying effects can be increased by increasing the area of cut fabric. As used herein, cut fabric refers to area defined by circumferential cut of the pants leg and a double row of stitching.

Figure 5:
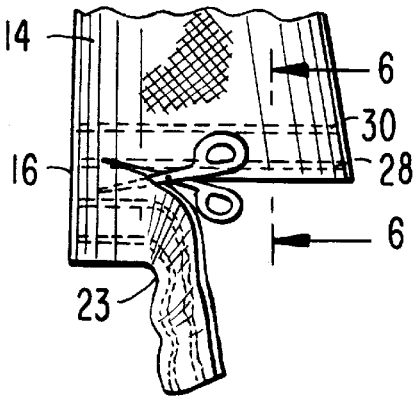
FIG. 5. is a partial sectional view of the frayable leg bottom showing the cutting of a bottom end of the leg at a second selected length in an area between spaced lines of stitchings to provide frayable bottom finish.
Figure 6:
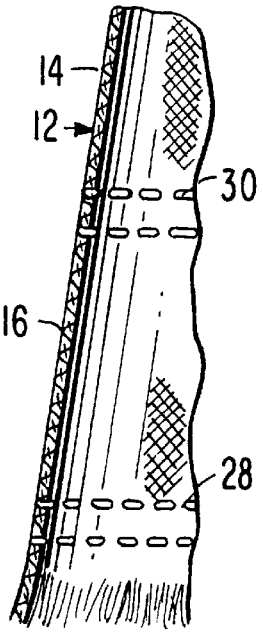
FIG. 6 is a partial sectional view of the frayable leg bottom with frayed finish taken along line 6—6 of FIG. 5.

FIGS. 5 and 6 show a similar alteration of the pants 10 by cutting of the legs 12 above the cuff area between double rows 26 and 28. The selective finishing in this leg area provides a single unfinished fabric layer 14 for fraying. Advantageously, the placement of multiple double stitching rows provides an adjustable pants length feature in the pants 10.

Accordingly, the length and extent of fabric fraying may be varied by cutting pants legs at selected spacings from the rows of double needle stitchings 24 to 30. Fraying increases by cutting the pants legs distant from the stitching rows. For example, in the pants alteration illustrated in FIGS. 3 and 4, the legs 12 may be cut below the first line of stitching 24 within the ¾ inch area defined by the cuff 18. Similar fraying areas of approximately 1½ inch are defined between double rows 24 to 30.

It will be recognized that the invention has general application to the finishing of garments other than denim jeans. Finishing techniques of the invention may be employed, for example, in finishing pant legs of all garment types including shorts, straight leg and bell bottoms, shirt sleeves and cuffs, jacket arms, and scarves. For such applications, stitching patterns may be provided in textiles which define guides for cutting the materials to impart to the textile selected fraying effects and sizing dimensions. In general, the invention technique may be employed in finishing all frayable textiles materials.

Similarly, although the drawings illustrate use of double needle stitching having a defined spacing, it should be understood that the type, location and number of stitching rows may be varied without departing from the invention.

Thus, other variations of structures, materials, products and processes may of course be devised. All such variations, additions, and modifications are nevertheless considered to be within the spirit and scope of the present invention, as defined in the claims appended hereto.

I claim:

1. A pair of pants having frayable leg portions, comprising at least two circumferential lines of thread sewn or stitched into each of the leg portions defining means for forming boundaries for fraying the leg portions and providing a uniformed frayed finish.

2. A pants according to claim 1, wherein the pants are made of denim material.

3. A pants according to claim 1, wherein the circumferential stitching is spaced ¾ inch or more from the leg bottom.

4. A pants according to claim 1, wherein the circumferential stitching is provided by a double needle top stitching.

5. A pants according to claim 1, wherein the leg bottom is unfinished.

6. A pants according to claim 1, including two circumferential thread leg stitchings which are spaced apart to provide guides for cutting the leg to a selected length.

7. A pants according to claim 6, wherein the circumferential thread stitchings are spaced approximately 1½ inches apart.

8. A pants according to claim 1, including three circumferential thread leg stitchings which are spaced apart to provide guides for cutting the leg to selected length.

9. A pants according to claim 8, wherein the circumferential thread stitchings are spaced approximately 1½ inches apart.

10. A textile fabric having frayable outer seam portions comprising at least two lines of thread stitching defining means for forming boundaries for fraying the outer seam portions and for providing a uniformed frayed finish.

11. A textile fabric according to claim 10, wherein the textile is made of denim material.

12. A textile fabric according to claim 10, wherein the thread stitching provides a guide for cutting the textile fabric to a defined dimension.

* * * * *